United States Patent [19]

Baryla

[11] Patent Number: 4,741,119

[45] Date of Patent: May 3, 1988

[54] ELECTROSTATIC DISPLAY BOARD

[76] Inventor: Stanley J. Baryla, 1740 W. Isabella Rd., Midland, Mich. 48640

[21] Appl. No.: 805,842

[22] Filed: Dec. 5, 1985

[51] Int. Cl.[4] ..... G09F 7/12

[52] U.S. Cl. ..... 40/594; 40/10 R; 40/158 R

[58] Field of Search ..... 40/10, 158, 159, 594

[56] References Cited

U.S. PATENT DOCUMENTS

| | | | |
|---|---|---|---|
| 2,586,039 | 2/1952 | Heggedal | 40/594 |
| 2,598,755 | 6/1952 | Birch | 40/158 R |
| 2,677,910 | 5/1954 | Morgan | 40/158 R |
| 2,758,402 | 8/1956 | Filmer | 40/152.1 |
| 2,886,907 | 5/1959 | Stephenson | 40/158 |
| 2,942,368 | 6/1960 | Gale | 40/158 R |
| 3,440,750 | 4/1969 | Toth et al. | 40/158 R |
| 3,466,774 | 9/1969 | Borresen | 40/591 |
| 3,924,879 | 12/1975 | Whright | 40/594 |
| 4,250,642 | 2/1981 | Riehle | 49/594 |

FOREIGN PATENT DOCUMENTS

| | | | |
|---|---|---|---|
| 655537 | 7/1963 | Italy | 40/621 |
| 842480 | 7/1960 | United Kingdom | 40/621 |
| 2117547 | 3/1982 | United Kingdom | 40/594 |

*Primary Examiner*—Gene Mancene
*Assistant Examiner*—Wenceslao J. Contreras
*Attorney, Agent, or Firm*—Gifford, Groh, VanOphem, Sheridan, Sprinkle and Dolgorukov

[57] ABSTRACT

A display board for displaying, behind a transparent window, a sheet document such as a paper document clinging electrostatically on the surface of a dielectric plastic backing board. The sheet document is covered by a sheet of transparent thin film plastic, preferably provided with a display window with a contrasting border or matte, which also tends to cling electrostatically against the sheet document with the result that the sheet document is sandwiched between the backing board and the sheet of transparent plastic film.

11 Claims, 1 Drawing Sheet

FIG. 1
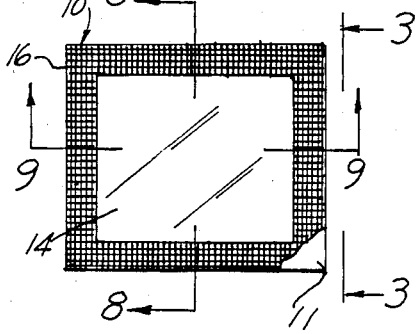
FIG. 2
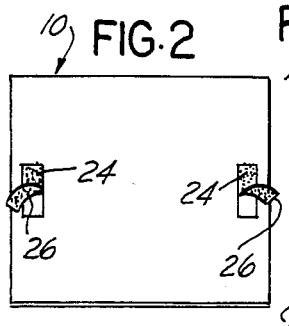
FIG. 3
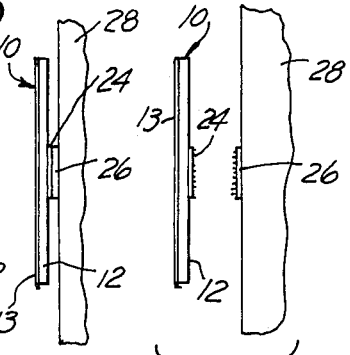
FIG. 4
FIG. 5
FIG. 8
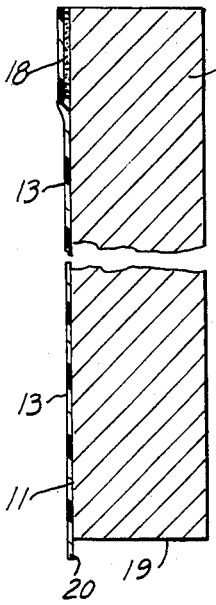
FIG. 8a
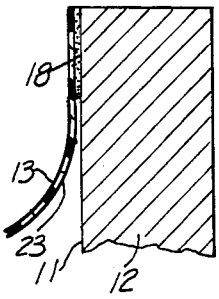
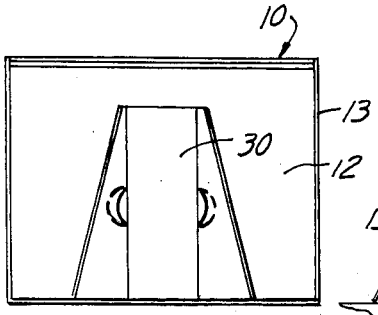
FIG. 6
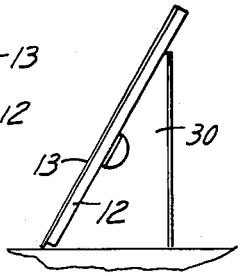
FIG. 7
FIG. 9
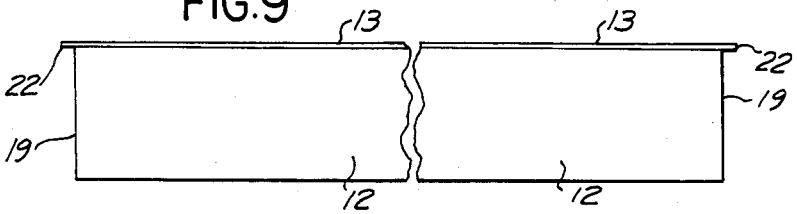
FIG. 10
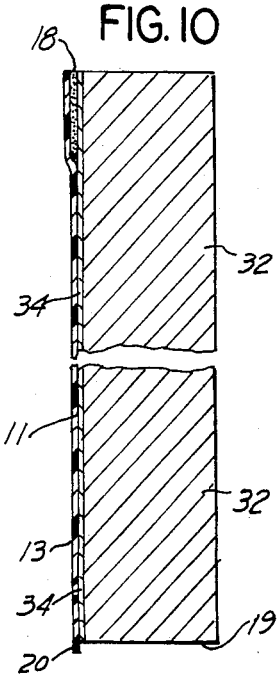
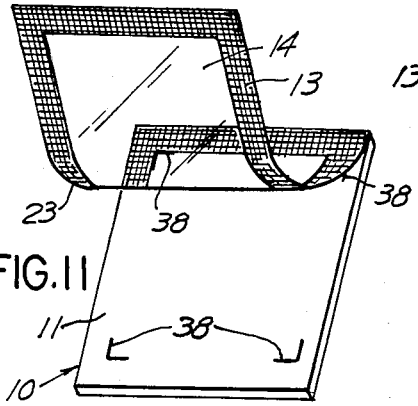
FIG. 11
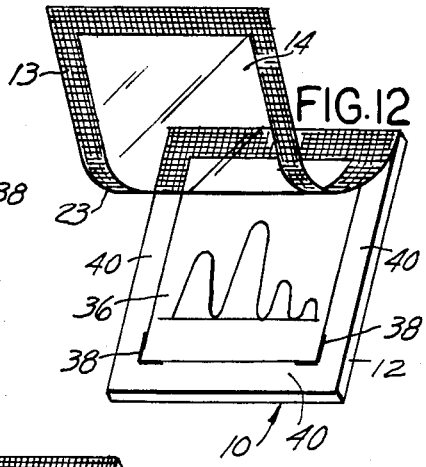
FIG. 12
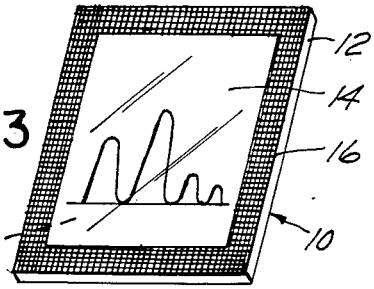
FIG. 13

ELECTROSTATIC DISPLAY BOARD

BACKGROUND OF THE INVENTION

The present invention relates to a display board in the form of a frame and holder for a sheet document such as a bulletin, chart, graph, photograph or any material that can be placed on a sheet of paper, and which relies on attraction caused by static electricity to hold the sheet document appropriately framed.

Frames are known which are provided with a removable back and a transparent window such that a picture, chart, diploma, etc. may be held in the frame behind the window and removed when desired. Other frames are known in which the material being displayed is permanently attached in the frame.

It is also known that when a dielectric material is rubbed, preferably with another dielectric material, it becomes electrically charged positively or negatively and attracts neutral or oppositely charged material by electrostatic force.

SUMMARY OF THE INVENTION

The present invention provides a display board, having the appearance of a frame, for a sheet holding a document being displayed behind a transparent window, and which relies on static electricity for maintaining the sheet document in position between a backing board and the transparent window provided, if so desired, with an appropriate marginal matte.

The many objects and advantages of the present invention will become apparent to those skilled in the art when the following description is read in conjunction with the accompanying drawing wherein like numerals refer to like or equivalent parts, and in which:

BRIEF DESCRIPTION OF THE DRAWING

FIG. 1 is a front elevation view of a display board according to the present invention;

FIG. 2 is a rear elevation view thereof;

FIG. 3 is a side elevation view thereof from line 3—3 of FIG. 1;

FIG. 4 is a view similar to FIG. 3 but showing the display board of the invention attached to a wall;

FIG. 5 is a view similar to FIG. 4 but showing the display board detached from the wall;

FIG. 6 is a rear elevation view of a modification of the display board of the invention;

FIG. 7 is a side elevation view of the modification of FIG. 6;

FIG. 8 is a transverse section along line 8—8 of FIG. 1, at a grossly exaggerated enlarged scale;

FIG. 8(*a*) is a partial view similar to FIG. 8 showing a detail of structure;

FIG. 9 is a section view from line 9—9 of FIG. 1;

FIG. 10 is a view similar to FIG. 8, but showing a modification thereof; and FIGS. 11–13 are perspective views showing the manner in which the display board of the invention is put to use.

DETAILED DESCRIPTION OF THE PREFERRED EMBODIMENTS

Referring to the drawing, and more particularly to FIG. 1, a display board 10 according to the invention comprises a backing plate or board 12 made of dielectric material which may be any synthetic resin having a high dielectric constant such as, for example ABS, acetal, acrylic, alkyd, epoxy, melomine, phenolic, polyamide, polycarbonate, polychlorotrifluroethylene, polyester, polyethrylene, polyamide, polyphenylene, polypropylene, polyurethane, styrene copolymer, or vinyl. Preferably, the backing plate or board 12 is made of relatively thick and rigid plate of acrylic resin having a smooth face 11 covered with a sheet 13 of transparent plastic film. Preferably, the transparent plastic film is made of a non-top coated (NTC) polyester, although it may be made of any one of the dielectric resins hereinbefore mentioned, obtainable in transparent film form, relatively stiff but nevertheless flexible. The sheet 13 of transparent plastic film forms a transparent window 14 provided at its border with a non-transparent matte 16 consisting generally of a thin coating of ink, black or any other appropriate color. Preferably, the marginal matte 16 is applied to the rear surface of the sheet 13 of transparent plastic film by any convenient printing method, such as silk screen printing, which permits to print any desirable art work, logo, trademark or the like, by appropriate masking.

The sheet 13 of transparent plastic film is, as best shown at FIGS. 8 and 8(*a*), attached at one edge to the backing plate 12, for example at its top margin, by means of a strip 18 of clear tape provided with an adhesive on both its surfaces. The sheet 13 of transparent plastic film is cut at its other three edges such as to project slightly beyond the edge 19 of the backing plate 12 as shown at 20 with respect to the bottom edge, FIG. 8, or at 22 with respect to the lateral edges, FIG. 9. In this manner, the slightly projecting edge 20 of the sheet 13 of transparent film at the bottom of the backing board 12, or any one of the slightly projecting lateral edges 22, may be engaged with a fingertip or a fingernail for peeling the sheet 13 of transparent plastic film away from the face 11 of the backing board or plate 12, when it is desired to insert a sheet document between the face 11 of the backing board 12 and the transparent plastic film window 14.

One advantage resulting from the attaching the sheet 13 of plastic film by means of a double-sided adhesive coated tape 18, rather than providing a living hinge arrangement, is that the side of the tape 18 attached to the back surface of the plastic film 13 prevents a substantial wide marginal portion of the sheet 13 of plastic film along its top edge from separating from the backing board or plate 12, with the result that the sheet 13 of transparent plastic film is flexibly bent when pulled away from the backing board 12, as shown at 23 at FIGS. 8(*a*) and 11–12, when it is desired to introduce a sheet document 36 between the face 11 of the backing board 12 and the plastic film window 14 for display of the sheet document through the window 14, and is springingly urged toward the face 11 of the backing board 12. It will be apprciated that the double-sided adhesive strip 18 may be replaed by a strong adhesive, although using the strip 18 provides a clearance between the back surface of the sheet 13 of transparent plastic and the face 11 of the backing board 12 accepting the sheet document 36 therebetween.

For removable attachment to a wall, the display board 10 can be provided with a hanging string or a hook, but is preferably provided with one or a pair of small patches of hook and loop material 24, attached on the back of the backing board 12, the surface of the outermost complementary hook or loop material 24 being coated with an adhesive which becomes exposed when a release cover 26 is peeled off. The display board 1 can thus be attached to a wall 28, as shown at FIG. 4, and removed from the wall 28, as shown at FIG. 5, by pulling away and separating the patches of complementary hook and loop material 24. Alternatively, the display board 10 may be provided with a easel-like support leg, or pair of legs 30, FIGS. 6–7, made preferably of a foldable piece of cardboard, such as to be capable of being supported on a surface such as a table top. It will be appreciated that the easel-type support legs 30, when unfolded flat against the rear surface of the backing board 12, enables the display board 10 to be attached to a wall, by means of the hook and loop material patches 24, FIGS. 2–5, or by any other convenient means.

As shown at FIG. 10, the backing board or plate 12 may be made economically by providing a cardboard backing plate 32 with a relatively thin coating 34 of vinyl, or other acrylic, dielectric resin, calendered to a smooth surface finish. The sheet 13 of transparent plastic film may be provided on its exterior surface with a mat finish resulting in a non-reflective surface for the window 14 and matte 16.

In use, and as shown at FIGS. 11–13, a sheet document, preferably a paper document 36, is placed applied against the face 11 of the backing board 12 which is preferably provided with scribed corner lines 38, FIG. 11 for proper placement of the sheet document 36 such as to be visible through the window 19. It is sufficient to rub with the hand the surface of the sheet document 36 to charge it electrostatically such that is clings to the face 11 of the backing board 12, and the cover sheet 13 of transparent plastic is caused to cling electrostatically to the surface of the paper document 36, and cling, in most instances, to the marginal surface portions 40 of the backing board 12 behind the matte 16. The paper document 36 thus remains in the display board 10 indefinitely, until it is desired to remove it simply by peeling the sheet 13 of thin transparent plastic film, by pulling it back as shown at FIG. 11 and peeling or slipping off the sheet document 36 from the face 11 of the backing board or plate 12.

Having thus described the present invention by way of typical structural embodiments thereof, modifications whereof will be apparent to those skilled in the art, what is claimed as new is as follows:

1. A display board for viewing a document comprising:

a plate having a dielectric plastic face having a plurality of perimetral edge portions;

a double-sided adhesive strip member affixed to said plate adjacent one of said plurality of perimetral edge portions;

a sheet of flexible transparent dielectric film having a first edge portion affixed to said double-sided adhesive strip member in a spaced apart relationship from said plate, said sheet having a cover portion movable between a contact position in which said cover portion of said sheet is drawn into contact with said plate by electrostatic force and a release position in which said cover portion of said sheet is not in contact with said plate, said sheet having a curved portion extending between said first edge portion and said curved portion, said curved portion having a radius of curvature extending from said curved portion in a direction outwardly from said plate, said curved portion extending between said strip member and said plate when said cover portion of said sheet is in said contact position such that said curved portion biasingly urges said cover portion of said sheet against said plate such that said document is held in position between said plate and said sheet by electrostatic force and said biasing force of said curved portion of said sheet, said sheet having a second edge portion extending beyond at least one of said plurality of perimetral portions.

2. The display board of claim 1 further comprising at least one patch of hook and loop complementary materials attached to a back surface of said plate, said patch having on its rear surface a coating of adhesive for attachment of said display board to a surface.

3. The display board of claim 1 further comprising an easel-like foldable leg member attached to a back surface of said plate.

4. The display board of claim 1 wherein said plate is made of an acrylic resin.

5. The display board of claim 1 wherein said plate is made of a cardboard backing having a surface coating of dielectric plastic.

6. The display board of claim 5 wherein said dielectric plastic coating is ana acrylic resin.

7. The display board of claim 5 wherein said dielectric plastic coating is a vinyl resin.

8. The display board of claim 1 wherein said sheet of transparent plastic film is made of polyester resin.

9. The display board of claim 1 wherein said sheet of transparent plastic film has a mat surface finish.

10. The display board of claim 1 wherein said sheet of transparent plastic film has a transparent window bordered by a contrasting matte.

11. The display board of claim 10 wherein said contrasting matte is applied by silk screen printing.

* * * * *

UNITED STATES PATENT AND TRADEMARK OFFICE

CERTIFICATE OF CORRECTION

PATENT NO. : 4,741,119

DATED : May 3, 1988

INVENTOR(S) : Stanley J. Baryla

It is certified that error appears in the above-identified patent and that said Letters Patent is hereby corrected as shown below:

Col. 2, line 56, delete "apprciated" and insert --appreciated--;

line 57, delete "replaed" and insert --replaced--.

Col. 3, line 2, delete "1" and insert --10--;

line 23, delete "mat" and insert --matte--;

line 31, delete "19" and insert --14--.

Col. 4, line 42, delete "anacrylic" and insert--an acrylic-- line 48, delete "mat" and insert --matte--.

Signed and Sealed this

Twentieth Day of September, 1988

*Attest:*

DONALD J. QUIGG

*Attesting Officer*

*Commissioner of Patents and Trademarks*